United States Patent [19]

Merkwitz

[11] 4,004,390

[45] Jan. 25, 1977

[54] SUPPORTING STRUCTURE WITH STRIP GRID PROFILE BARS FOR WALL OR CEILING COVERINGS

[75] Inventor: Günther Merkwitz, Freudenberg, Germany

[73] Assignee: Odenwald Faserplattenwerk G.m.b.H., Amorbach, Germany

[22] Filed: Dec. 5, 1974

[21] Appl. No.: 529,730

[30] Foreign Application Priority Data

July 26, 1974 Germany ..... 2435978

[52] U.S. Cl. ..... 52/484; 52/28; 52/488; 404/1

[51] Int. Cl.[2] ..... E04B 5/52

[58] Field of Search ..... 52/126, 28, 35, 484, 52/237, 483, 488, 489, 486, 758 A; 46/29

[56] References Cited

UNITED STATES PATENTS

| | | | |
|---|---|---|---|
| 1,347,808 | 7/1920 | Franklin | 46/29 |
| 2,981,386 | 4/1961 | Reske | 52/484 |
| 3,089,570 | 5/1963 | O'Neil | 52/484 |
| 3,318,057 | 5/1967 | Norsworthy | 52/126 |
| 3,343,309 | 9/1967 | Netz | 52/28 |
| 3,372,518 | 3/1968 | Rensch | 52/237 |
| 3,470,658 | 10/1919 | Orliac | 52/28 |
| 3,628,299 | 12/1971 | Nakazawa | 52/483 |
| 3,696,571 | 10/1972 | Schluter | 52/758 A |
| 3,848,385 | 11/1974 | Thompson | 52/484 |

FOREIGN PATENTS OR APPLICATIONS

| | | | |
|---|---|---|---|
| 1,577,362 | 6/1969 | France | 52/126 |
| 848,244 | 9/1952 | Germany | 52/484 |
| 782,965 | 9/1957 | United Kingdom | 52/237 |
| 326,643 | 3/1930 | United Kingdom | 46/35 |
| 1,104,351 | 2/1968 | United Kingdom | 52/484 |

*Primary Examiner*—Ernest R. Purser
*Assistant Examiner*—Henry Raduazo

[57] ABSTRACT

A light weight locking structure for a suspended ceiling construction of T-shaped strip grid profile bars supportively engaged by nodal plates having radiating arms in which the arms terminate in upwardly bent locking projections, and the profile bars are provided with slots in the cross-bar of the T for cooperatively receiving the locking projections of the associated arm. After engagement of the locking projections in the slots of the respective profile bar, the projections are bent over to rigidly lock the profile bars to the nodal plate.

7 Claims, 46 Drawing Figures

SUPPORTING STRUCTURE WITH STRIP GRID PROFILE BARS FOR WALL OR CEILING COVERINGS

The invention relates to a supporting structure for strip grid profile bars intended to support panels, walls or the like and consisting of a cross-jointing piece or nodal plate with an arrangement for attachment on a bare ceiling and a locking device between nodal plate and strip grid profile bar.

It is known to provide the interiors of industrial buildings particularly ceilings, with coverings which are suspended from the bare ceiling by the unit construction principle and which can be constructed in varying forms. Also dwelling rooms can be provided with such ceiling coverings. For this purpose, strip grid profile bars which may be constructed for example with a T-shaped cross-section, are suspended from the bare ceiling to form a latticework.

Inserted into the intermediate spaces are panels which are for example horizontally disposed, being laid onto the horizontally extending support edges of the profile bars. As a rule, the panels are so dimensioned that they correspond to the lattice grid and occupy the rectangular or square space, as the case may be, between the strip grid profile bars.

Another type of ceiling covering is the grid or honeycomb ceiling in which the panel elements are mounted vertically on the strip grid profile bars. The honeycomb ceiling provides a dazzle-free lighting surface with a good soundproofing action. Lighting devices are easily fitted and the panels can be exchanged without difficulty. Furthermore, the ceiling space of such a grid ceiling is conveniently accessible, since no further elements have to be fitted over the vertically-mounted panels or at least in a few cases panels may be fitted just in a loosely horizontal position.

Problems have frequently arisen at the points of intersection by virtue of the fact that practical nodal plates ought to be provided at those places where the strip grid profile bars intersect, generally at an angle of 90°. In order to produce honeycomb ceilings or triangular or hexagonal structures, complicated joints were provided which were conducive neither to decorative appearance nor economical manufacture nor practical handling.

According to the invention, therefore, the problem is so to improve a supporting structure of the type mentioned at the outset that a simple and functionally reliable nodal plate can be used both with triangular and with hexagonal structures, utilising the commercially available profile bars; in the case of an embodiment preferably both for flat plane ceilings, in which the panels are inlaid, as well as for grid ceilings in which the panels stand vertically on the strip grid profile bars and, in the case of another form of embodiment, in such a manner that also three-dimensional ceiling coverings or wall coverings can be provided using non-formable materials.

According to the invention, the problem is resolved in that the nodal plate or cross-joint piece consists of a flat piece located substantially in one plane, stellate in plan view, with arm-like extension pieces, the width of the relevant arm-like extension piece being equal to the width of the strip grid profile bar which is itself T-shaped in cross-section and which has recesses to accommodate locking projections disposed at the free ends of the arm-like extension pieces.

As in the case of a structural assembly having such a cross jointing piece, it is possible firstly easily and advantageously to conceive of a systematic triangular or hexagonal construction, the strip grid profile bars being fitted easily onto the economically prepared cross-jointing pieces, being locked thereby against all movements in the horizontal plane. The cross-jointing piece or nodal plate has in this case expediently in its centre an aperture by means of which a hook can be so fitted by an inserted screw that the cross-jointing piece can itself be suspended in known manner from the bare ceiling and carry the extended strip grid profile bars. The stamping-out of such a cross-jointing piece is very economical, because except for the locking projections all functional elements lie in one plane. The locking projections themselves may consist of tongues or lugs bent through approximately 90° out of the main plane and inserted very easily into slot-like cut-outs in the supporting edges of the strip grid profile bars. For final fixing, the locking projections can, after being passed through the slots, again be bent over through about 90° so that they come to lie flat on the main plane of the cross-jointing piece. The particular strip grid profile bar involved is then rigidly connected to the associated arm-like extension piece.

In the case of a favourable further development of the invention, the cross-jointing piece has three arm-like extension pieces disposed in each case at an angle of 120° with respect to the others. Thus it is possible to set up triangular structures for flat plane or grid ceilings.

According to the invention, in the case of another form of embodiment, it is expedient for the nodal plate to have six arm-like extension pieces staggered at 60° with respect to one another. Thus the simple hexagonal structure is made possible.

The T-shaped strip grid profile bars described have been available in the trade for many years. The advantage of the structure according to the invention resides in the fact that only the slot-like cut-outs have to be provided in the supporting edges of the bars in order to make them suitable for the triple or six-fold nodal plate.

According to the invention, it is furthermore particularly advantageous if for vertical adjustment of the panels on the strip grid profile bars and for securing the same, a cross-sectional hexagonal profile member is provided which can be so fitted onto the middle part of the nodal plate that its six walls, in plan view, come to lie with the relevant interface between the middle part and the arm-like extension pieces of the nodal plate, and if there are provided on the walls on the sides with the panels two vertically extending ribs for fitment into corresponding cut-outs in the panels. This profile member supports the structure particularly in the case of grid ceilings in which the panels are set up vertically on the strip grid profile bars, as is described above. For the rigidity of the structure is considerably improved by the profile member.

Furthermore, the easy adjustability both of the hexagonal profile member at the point of intersection or nodal point as well as of the vertically upwardly projecting panels into the ribs of the already inserted profile member permit of easy exchangeability of one element or the other.

For the triangular structure, it is far more expedient to provide vertical ribs on every second one of the six walls of the profile member, because only at these points, i.e. starting from the middle point, three vertically upright panels are provided.

Accordingly, for the provision of a hexagonal structure for grid ceilings, in which the panels stand at right-angles in the profile bars, it is advantageous to provide vertical ribs on each of the six walls of the profile member. The height of the hexagonal profile member is equal to the height of those panels which are to be laid in the grid ceiling. The profile member may consist of aluminium or synthetic plastics material, both of which have a low specific weight, and nevertheless an absolutely adequate fixing of the convergent profile bars, with the inserted panels, is guaranteed.

Whereas with the above-described cross-joint piece or nodal plate, for the plane ceiling, any desired lattice systems can very expediently and attractively be provided because the arm-like extension pieces are disposed on the nodal plate in an arrangement whereby they are staggered around the periphery at different degrees with respect to one another, for example 60°, 120°, etc., these structures are nevertheless all in just one plane.

The supporting structure mentioned at the outset is therefore also very expediently constructed for plastic or three-dimensional ceiling coverings or wall coverings with nondeformable materials, in that at least one of the arm-like extension pieces is bent out of the plane of the middle piece. Advantageously, at least one arm-like extension piece on which the T-shaped profile bar is mounted, is angled upwardly or downwardly on the plane of the middle piece of the nodal plate. In this way, it is possible with the simplest of means to provide plastic or three-dimensional linings on ceilings and walls. For prestigious rooms such as for example entrance halls, conference rooms, etc., this arrangement provides a good looking, practical and nevertheless not too expensive covering, particularly for the ceilings of these rooms. In the past, materials were used for this purpose, which can be themselves worked, e.g. cassettes of metal or synthetic plastics material. By reason of the invention, however, it is now possible to use for such coverings also plasterboard, wood or mineral fibre panels which can be mounted on an inexpensively produced sub-structure which can be built into place. The last-mentioned materials cannot be worked, nor can they be easily secured by nailing or screwing to bent metal cassettes. By reason of the nodal plates according to the invention, however, an inexpensive sub-structure is provided onto which even mineral fibre panels can be fitted without considerable labour cost.

In an advantageous further development of the invention, the plane middle piece of the nodal plate is a polygonal surface having at least three edges. If an arm-like extension piece is mounted on each edge, then it is possible in this way for three profile bars with panels in place to be brought together at the relevant nodal point. It is however not necessary for each edge to have an arm-like extension piece. Namely, it may be necessary to provide on one side or corner of the grid of the sub-structure only two profile bars which then need to be connected to each other at the point of contact. In the case of a nodal point at which three, four or more profile bars are to be joined to one another, then a middle piece having a correspondingly greater number of edges with arm-like extension pieces mounted on it will have to be used.

According to the invention, it is also ideal for the arm-like extension pieces to be bent over along the edges at the same angle with respect to the plane of the central piece. As a rule, the arm-like extension pieces will consist of one piece with the middle piece, because the manufacture of such a nodal piece is more economical or the assembly thereof is more time-saving. For the covering to have an attractive appearance, the depressions into the third dimension are as a rule of regular construction and this very fact can be achieved by reason of the foregoing feature of the bending-over at the same angle with respect to the plane of the middle piece.

Furthermore, in the case of another expedient form of construction of the invention, it is favourable for the arm-like extension pieces, viewed in their plane development, to be staggered at unequal angles with respect to one another. It will be recognised as being entirely possible to produce nodal plates of different design on one and the same principle, so that nodal points can be formed at which in every case the desired number of profile bars can converge at whatever angle is desired.

According to the invention, it is furthermore of particular advantage for at least one arm-like extension piece to be bent over towards one side and at least a further arm-like extension piece to be bent over to the other side of the plane of the middle piece. The possibilities of spatial design in the third dimension, viewed from the plane of the covering, are greatly widened by this measure. The angling of the arm-like extension pieces on the middle piece to one side and to the other is ideally undertaken at the nodal pieces of a central plane, because as a rule it is there that there is a need to provide oblique connections from one plane to the other, namely via the third middle plane.

It is furthermore expedient if, according to the invention, locking projections for fixture of the profile bars are provided at the ends of the arm-like extension pieces. The locking projections may be bent upwardly in the manner of studs. During assembly of the profile bars which have corresponding slots at their ends, the locking projections are inserted into the slots and are then bent over thereby providing a rigid connection of the two parts of the construction, namely of the profile bar and of the nodal plate.

Further advantages, characteristics and applications of the present invention will be shown in the following description in connection with the drawings, in which.

Figure 1:
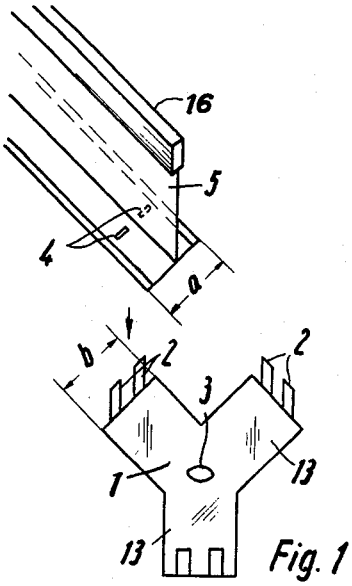
FIG. 1 is a perspective view of the triangle construction showing seperately a fragmentary end of the strip grid profile bar and an associated nodal plate.

With reference to FIGS. 1 to 5, an example of embodiment of triangular supporting structure will first be described. The cross-jointing piece or nodal plate 1 in FIG. 1 has, in a staggered relationship with respect to one another, three arm-like extension pieces 13 on the free ends of which there are locking projections 2.

The width *a* of a relevant arm-like extension piece 13 of the nodal plate 1 is equal to the width of the T-shaped strip grid profile bar 5 which has a top longitudinal stiftening member 16. Underneath, this has two equally wide *a*/2 supporting edges which together form the cross-bar of the T. The locking projections 2 have to be passed through recesses 4 which are disposed one in each of the supporting edges of the T-shaped strip grid profile bar 5 as shown in FIG. 1.

Figure 2:
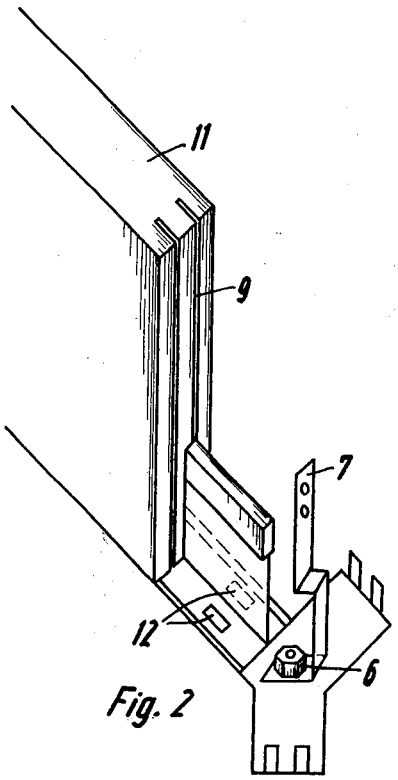
FIG. 2 is a perspective view of the two parts illustrated in FIG. 1 joined together as a single structure element supporting a fragmentary panel.

For locking connection of the profile bars to the nodal plate 1, the projections 2 are then bent longitudinally over onto the supporting edges of the profile bars 5 so that they assume the positions shown at 12 in FIG. 2.

In the middle, the nodal plate 1 has an aperture 3 through which, according to FIG. 2, it is possible to pass a screw 6 which in turn establishes the connecton with a hanger 7 by which the nodal plate pieces 1 can be hung from the bare ceiling, not shown.

FIG. 2 shows connected to each other the two parts shown in FIG. 1, namely the nodal plate 1 and the strip grid profile bar 5 with the plane panel 11 partially in place on the profile bar 5. The locking projections 2 have been passed through the cut-outs 4 in the profile bars 5 and then bent over, as indicated by the reference numeral 12, so that now the plane of the connecting seam or locking projections 2 lie in the main plane of the nodal plate piece. The nodal plate piece is now rigidly connected to the profile bar 5.

Figure 3:
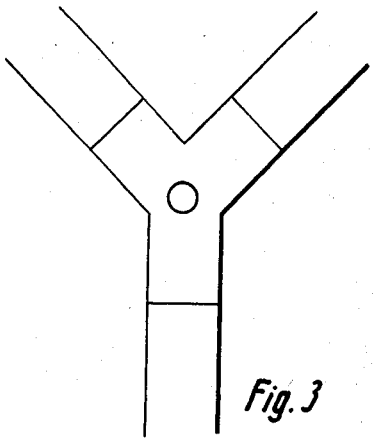
FIG. 3 is a fragmentary bottom plan view of the joining construction of FIG. 2.

FIG. 3 is a view from below showing the point of intersection described, in the installed condition, the strip grid profile bars being only partially shown. This view also shows that the width of the arm-like extension pieces 13 of the nodal plate 1 is equal to the width *a* of the relevant strip grid profile bar.

Figure 5:
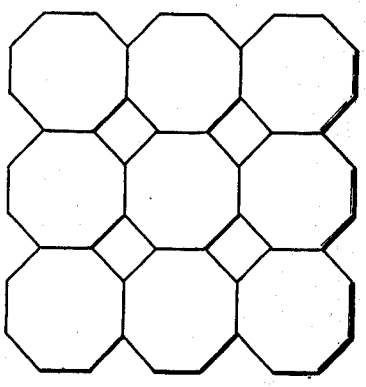
FIG. 5 shows the pattern of an octagonal honeycomb cover.

FIG. 5 shows the honeycomb profile which can be produced by means of this structure. In this octagonal structure, then, flat plane panels 11 can be vertically positioned.

Figure 4:
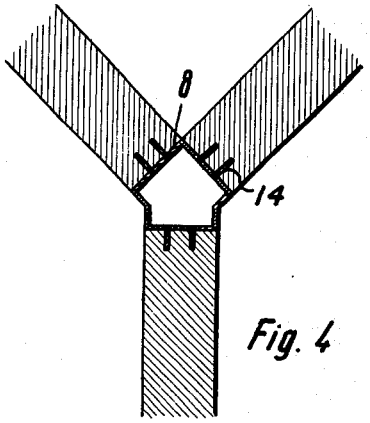
FIG. 4 is a fragmentary cross-section of the construction of FIG. 3 with the profile member inserted.
Figure 9:
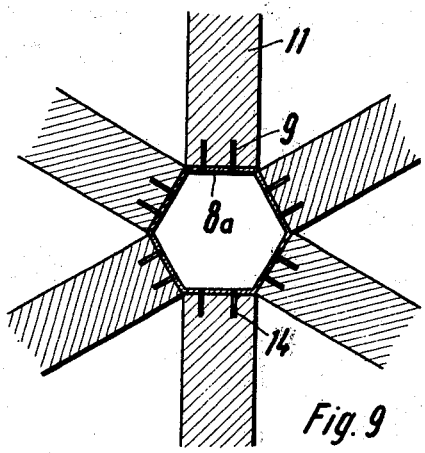
FIG. 9 is a fragmentary section through the structure according to FIG. 7 with a hexagonal profile member inserted.
Figure 7:
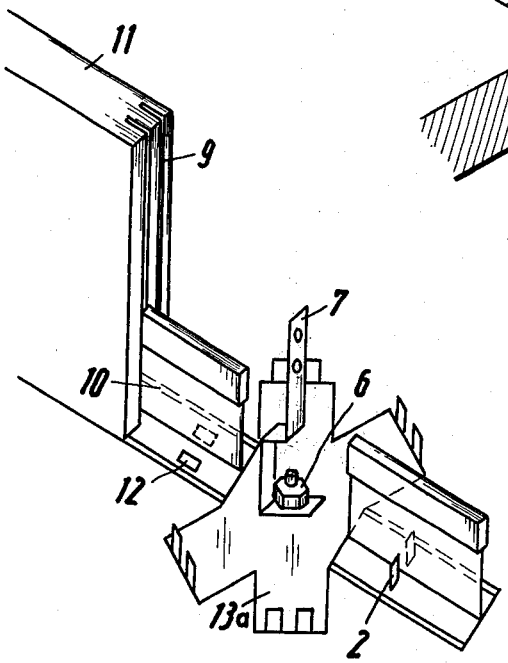
FIG. 7 shows a perspective view of the parts illustrated in FIG. 6, connected to one another and including a vertically fitted panel.

So that these are held more satisfactorily and are secured with respect to the adjacent panels, a profile member 8*a* is used which according to FIG. 9 is hexagonal, its height being approximately equal to that of the panels 11 used. FIG. 4 shows another type of profile member 8 in the installed condition. Provided on three of the seven walls of the profile member 8 are vertical ribs 14 (FIG. 4) which can be inserted in the slot-like recesses 9 in the panel 11, as illustrated in FIG. 2.

FIGS. 6 to 10 show another embodiment illustrating hexagonal structure. Identical parts carry identical reference numerals so that the foregoing description can be largely applied to the embodiment of FIGS. 6 to 10.

Figure 6:
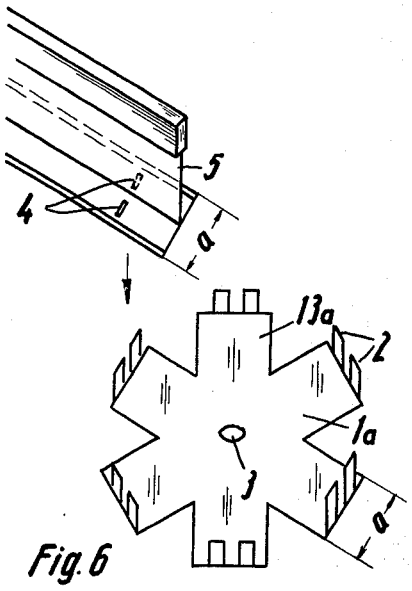
FIG. 6 shows a perspective view similar to FIG. 1 except for a hexagonal instead of a triangular structure, illustrating the relationship between nodal plate and strip grid profile bar.

FIG. 6 shows a nodal plate 1*a* provided with six outwardly radiating arm-like extension pieces 13 having angular spacings of 60° between adjacent arms. The attachment of profile bar 5 to the nodal plate according to FIG. 7, with the locking projections 2 being passed through the cut-outs 4 in the profile bar 5 and then bent over at 12, are all again effected as described in connection with FIG. 2 and the embodiment shown therein.

Figure 8:
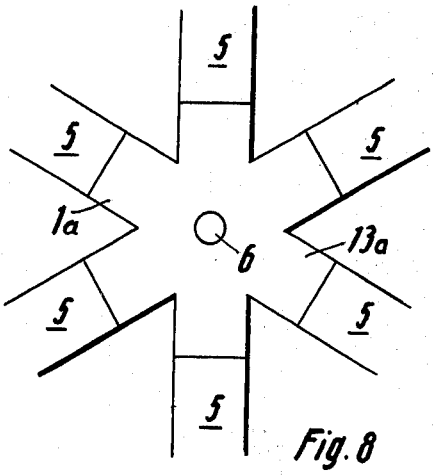
FIG. 8 is a fragmentary view of the hexagonal structure of FIG. 7 in the installed condition, viewed from below.

The bottom plan view of the hexagonal nodal plate of FIG. 8 corresponds to that of the triangular plate of FIG. 3, and FIG. 9 shows the hexagonal profile member 8*a* which has on each of its six walls vertical ribs 14. It will be seen that this is necessary in order for the six converging strip grid profile bars 5 to be joined to one another at the nodal plate 1*a*. The width of the arm-like extension pieces 13*a* of the cross-joint piece 1*a* corresponds not only to the width of the strip grid profile bar 5 at the bottom, but also to the width of the relevant walls of the hexagonal profile member 8*a*. In this way, it is possible for the plan view of the six walls of the profile member 8*a* to coincide with the imaginary border line between the middle part of the nodal plate 1*a* and its extension pieces 13*a*. This ratio of dimensions will naturally apply also to the embodiment shown in FIGS. 1 to 5.

Figure 10:
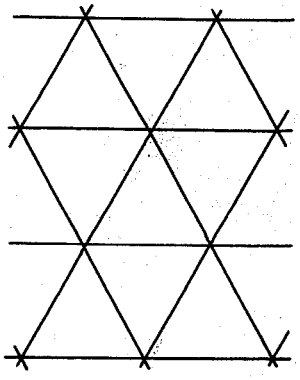
FIG. 10 shows a diagrammatic view of the hexagonal structure in the installed condition.
Figure 11:
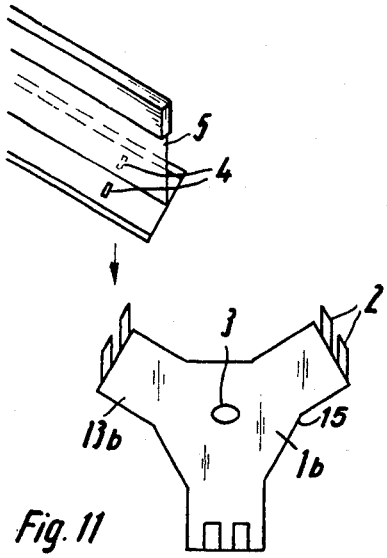
FIGS. 11 to 13 are views similar to FIGS. 1 to 3, respectively of a triangular structure having a differently designed nodal plate.
Figure 13:
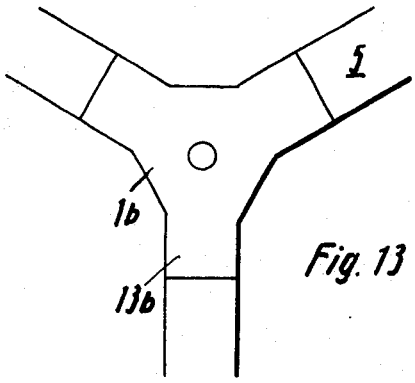

FIG. 10 diagrammatically illustrates the hexagonal structure which can be achieved by using the nodal plate 13*a* according to the invention.

Figure 14:
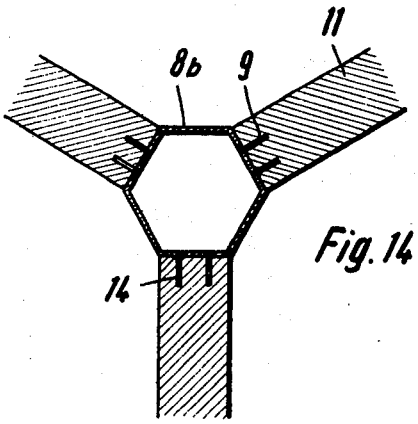
FIG. 14 shows a fragmentary cross-section of the construction of FIG. 13, with a hexagonal profile member inserted.
Figure 12:
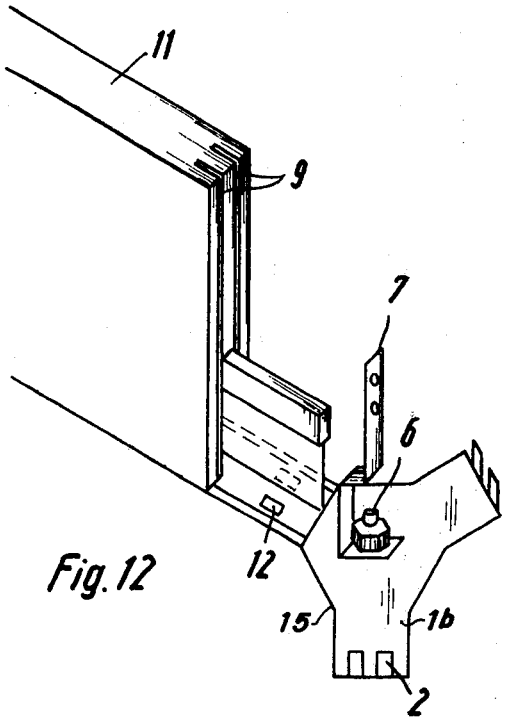

FIG. 5 also shows that it is possible with the structural assembly described to provide further possible constructions, e.g. an octagonal structure. FIGS. 11 to 14 illustrate a modification similar to that shown in FIGS. 1 to 4, in which the nodal plate 16 differs somewhat from the nodal plate 1 in that the adjacent sides of the respective adjacent arms 13*b* of the nodal plate 1*b* instead of intersecting as in nodal plate 1, each meet a line 15 which subtends the angle which would be formed by the intersection of the adjacent sides of two adjacent arms 13*b* as clearly shown in FIGS. 11 to 14. As shown in FIG. 14, the profile member 8*b* is hexagonal in cross-section and has vertical ribs 14 only on the sides associated with the arms 13*b* and panels 11.

Figure 15:
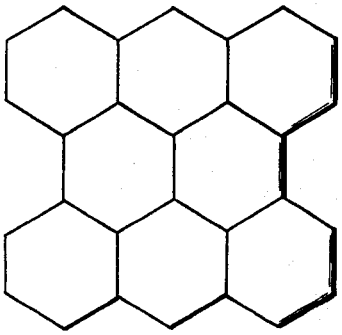
FIG. 15 shows the pattern of a hexagonal honeycomb cover.

FIG. 15 shows a pattern of hexagonal honeycomb cover, which may be formed from the nodal plates according to this invention.

Figure 16A:
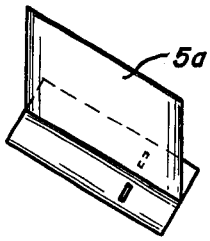
FIG. 16a is a perspective view of a profile bar for use with the nodal plate of FIG. 16.
Figure 16:
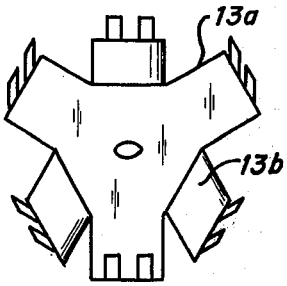
FIG. 16 is a perspective view showing a nodal plate for a hexagonal structure in which three arm-like extension pieces are bent out of the plane of the middle piece.
Figure 17:
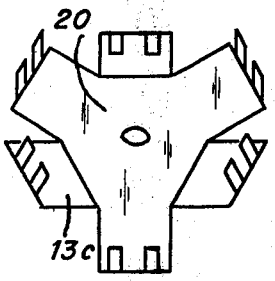
FIG. 17 shows a nodal plate with six arm-like extension pieces, similar to FIG. 16.
Figure 18:
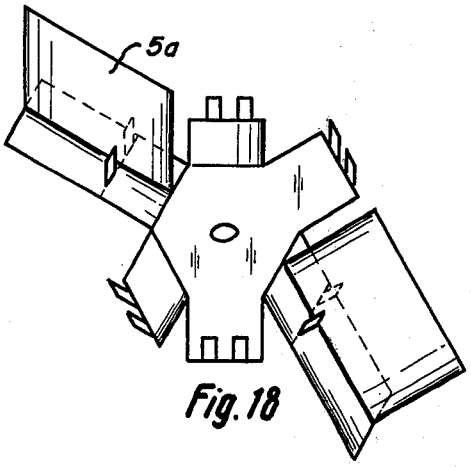
FIG. 18 shows the nodal plate according to FIG. 16 with two profile bars fitted.
Figure 19:
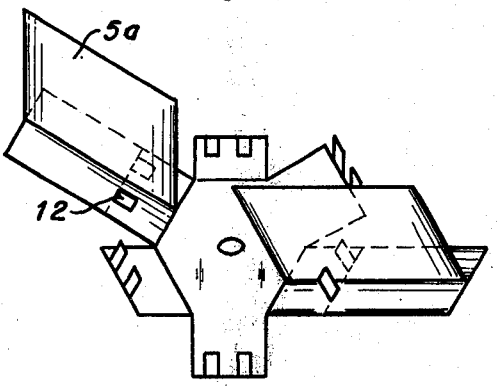
FIG. 19 is a view similar to that in FIG. 18 but in which one profile bar is bent over towards the other side.
Figure 20:
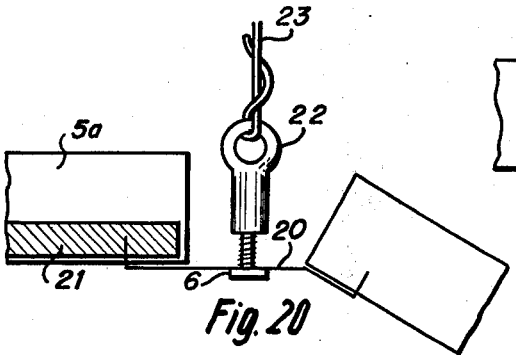
FIG. 20 shows a side view as a diagrammatic section through the arrangement in FIG. 18, in which a mineral fibre panel has already been inlaid on one side.
Figure 21:
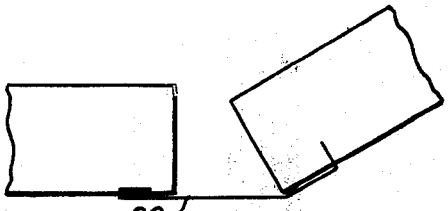
FIG. 21 is a diagrammatic side view of the arrangement shown in FIG. 19.

FIGS. 16 to 21 illustrate various configurations using a nodal plate identical with nodal plate 1*a* except that alternate arms 13*a* have either been bent downwardly as shown at 13*b* in FIGS. 16, 18 and 20, and upwardly as shown at 13*c* in FIGS. 17, 19 and 21. The T-shaped profile bar 5*a* of FIGS. 16 to 21 is identical with the profile bar 5 except that the longitudinal stiffening member 16 has been omitted in the profile bar 5*a*.

Figure 29:
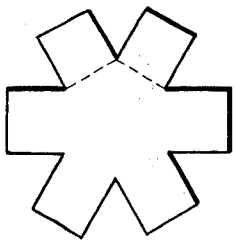
FIGS. 27 to 32 show plan views of different forms of embodiment of nodal plates.
Figure 28:
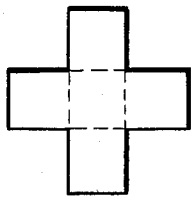
Figure 27:
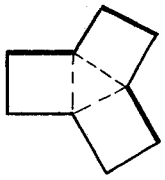
Figure 31:
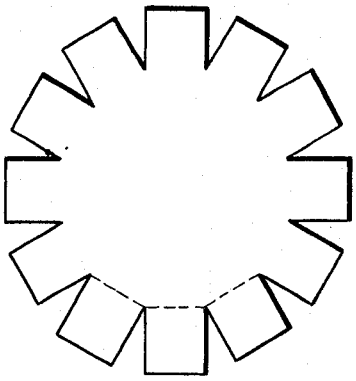

FIGS. 22 to 26 diagrammatically show the nodal plate 1*a* which is also shown in perspective in FIGS. 16 to 19 and in lateral section in FIGS. 20 and 21. It has a flat middle portion 20, the boundary edges of which are indicated in FIG. 29 by the broken lines. In the case of the forms of embodiment shown here, the arm-like extension pieces 13*a* are adjacent to each middle portion 20 beyond the aforesaid edges.

In the middle of the nodal plate 1 is an aperture 3 through which according to FIG. 2 it is possible to pass a screw 6 which in turn establishes the connection with a hanger 7 by which the nodal plate 1 can be hung from the bare ceiling, not shown.

FIG. 18 shows the connection with the T-shaped profile bar 5*a*. FIG. 19 corresponds to FIG. 17 but likewise in conjunction with the T-shaped profile bars 5*a*. It is shown at 12 on the left-hand side of FIG. 19 that by folding-over the locking projections 2, it is possible to achieve a locking effect between the nodal plate and the profile bar 5*a*.

FIG. 20 shows a cross-section through the view in FIG. 18, it being shown on the left-hand side that between the profile bars 5*a* it is possible to insert covering panels, e.g. mineral fibre panels 21. In the middle of FIG. 20 is shown a hanger 7*a*, comprising a screw 6 passing through the aperture 3 in the middle portion 20 and engaging an eye-nut 22 supported by a wire 23.

Figure 32:
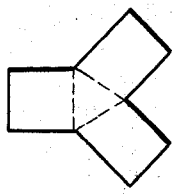
Figure 30:
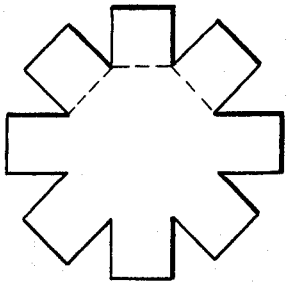
Figure 22:
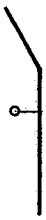
FIGS. 22 to 26 diagrammatically illustrate nodal plates, viewed from the side, having differently bent arm-like extension pieces.
Figure 23:
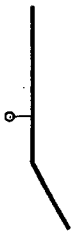
Figure 24:
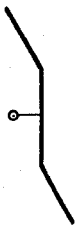
Figure 25:
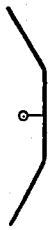
Figure 26:
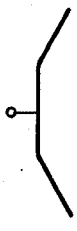

FIGS. 22 to 26 illustrate diagrammatically and in section that the individual arm-like extension pieces 13*a* of the nodal plate 1*a* may be angled over in different ways. FIG. 22 shows that the extension piece 13*a* remains partially in the horizontal and is partially angled upwardly. FIG. 23 corresponds to FIG. 22, the angling-over of the extension piece 13*a* being downwards. FIG. 24 shows how the arm-like extension pieces 13*a* can be angled in part both upwardly and also downwardly. FIG. 25 shows that all extension pieces 13*a* can be bent upwardly while FIG. 26 shows that all can be bent downwardly. FIGS. 27 to 32 show the possible plan views of various modifications of nodal plates, the broken lines indicating the bountary edges of the flat middle portions. They can according to FIG. 27 have three arm-like extension pieces while those according to FIG. 28 may have four extension pieces or according to FIG. 29 six or according to FIG. 30 eight and according to FIG. 31 twelve arm-like extension pieces. FIG. 32 shows that the angle of the individual extension pieces such as pieces 13 with respect to one another need not absolutely be identical. FIGS. 33 to 39 show in plan view the possible types of ceiling which can be formed by using the various nodal plates described in the foregoing, the more heavily drawn lines in each case forming the basic plane of a ceiling covering. The thinner lines become remote from this basic plane either upwardly or downwardly and end at a nodal plate to produce a three-dimensional sub-structure into which, then, the covering panels 21 can be fitted.

Figure 33:
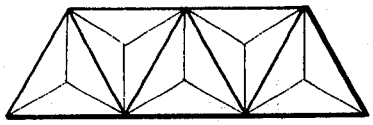
FIGS. 33 to 39 show plan views of examples of lattice structures which can be assembled using the individual nodal plates.
Figure 34:
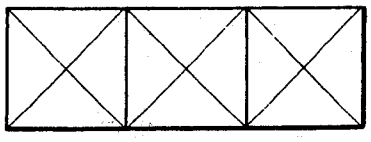
Figure 35:
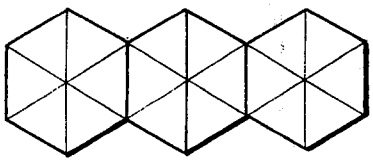
Figure 36:
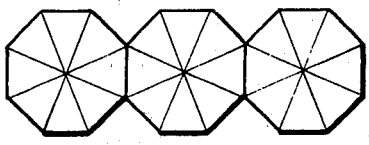

According to FIG. 33, the basic plane of the ceiling forms a triangle; according to FIG. 34 a four-sided figure; according to FIG. 35 a hexagon and according to FIG. 36 an octagon.

Figure 37:
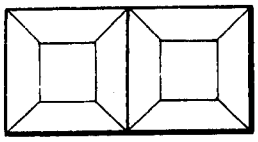
Figure 38:
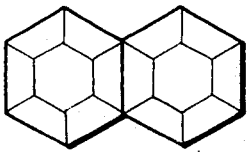
Figure 39:
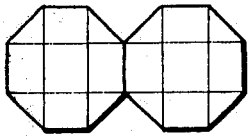
Figure 40:
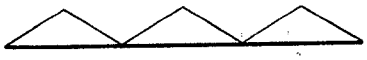
FIGS. 40 to 45 diagrammatically show in side elevation the individual forms of embodiment of the lattice-like sub-structures.
Figure 43:
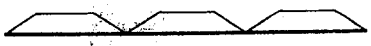
Figure 41:
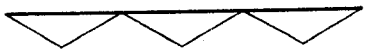
Figure 44:
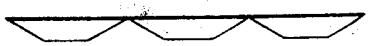
Figure 42:
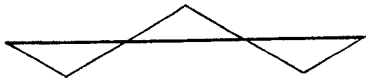
Figure 45:
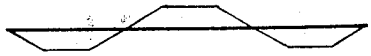

FIGS. 40 to 42 show diagrammatic cross-sections through the views illustrated in FIGS. 33 to 36. They show that the structure and thus the ceiling coverings may be constructed to jump backward from the basic plane (FIG. 40) or forward (FIG. 41), or may be constructed to jump forward or backward (FIG. 42). FIGS. 37 to 39 show corresponding but different forms of construction compared with those of FIGS. 34 to 36. FIGS. 43 to 44 show the cross-sections through FIGS. 37 to 39, respectively.

What I claim is:

1. In a supporting structure for a suspended ceiling having nodal plates suspended from above and provided with a plurality of radiating arm-like extension pieces supportively engaging a plurality of T-shaped strip grid profile bars, means for rigidly locking the profile bars to the respective associated extension pieces of the nodal plates, comprising a plurality of upwardly bent locking projections extending from the outward end of each of said extension pieces, and the cross-bar of the T of each of said profile bars adjacent the end thereof associated with the respective engaging extension piece being provided with an equal plurality of slots adapted to receive said projections of said respective extension piece, such that when the ends of said profile bars are disposed in overlying engagement with the respective extension pieces said projections are engageable in and extendable through and above the respective slots of the associated profile bars, the portions of said projections extending above said slots being adapted to be longitudinally bent over on the cross-bar of the T of the associated profile bar for producing a rigid connection, and each extension piece of each of said nodal plates being respectively equal in width to the cross-bar of the T of the associated profile bar said nodal plate having six of said extension pieces which are disposed in a staggered relationship, each one at 60° with respect to one another, said profile bars being adapted to support vertical panels in vertical adjustment relation thereto and characterized, in that said extension pieces extend outwardly from the boundary of a middle portion of a respective nodal plate, in that a vertical wall profile member of hexagonal cross-section is provided which is adapted to be fitted on said nodal plate so that the ends of its six walls lie on said boundary, in that at least one of said walls is provided with two outwardly-extending vertical ribs, and in that the panels associated with said profile bars are provided with vertically-extending slot-like recesses cooperatively engageable with said ribs.

2. A supporting structure according to claim 1, characterized in that said profile bars are adapted to support vertical panels in vertical adjustment relation thereto, that said extension pieces extend outwardly from the boundary of a middle portion of a respective nodal plate, that a vertical wall profile member of hexagonal cross-section is provided which is adapted to be fitted on said nodal plate so that the ends of its six walls lie on said boundary, that at least one of said walls is provided with two outwardly-extending vertical ribs, and that the panels associated with said profile bars are provided with vertically-extending slot-like recesses cooperatively engageable with said ribs.

3. A supporting structure according to claim 2, characterized in that a pair of vertical ribs are provided on alternate walls of the six walls of said profile member.

4. A supporting structure according to claim 2, characterized in that on each of the six walls of said profile member there are a pair of vertical ribs.

5. A supporting structure according to claim 1, characterized in that said extension pieces extend outwardly from a middle portion of a respective nodal plate and that at least one of said extension pieces is bent out of the plane of said middle portion.

6. A supporting structure according to claim 5, characterized in that said middle portion is a plane polygon with at least three edges demarking bends of said extension pieces out of the plane of said polygon.

7. A supporting structure according to claim 6, characterized in that said extension pieces are bent along said edges at the same angle with respect to said middle portion.

* * * * *